US007518574B2

(12) United States Patent
Park et al.

(10) Patent No.: US 7,518,574 B2
(45) **Date of Patent: *Apr. 14, 2009**

(54) APPARATUS FOR ENERGY RECOVERY OF PLASMA DISPLAY PANEL

(75) Inventors: Joong Seo Park, Daegu (KR); Yun Kwon Jung, Gumi-si (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/591,587

(22) Filed: Nov. 2, 2006

(65) Prior Publication Data

US 2007/0052623 A1 Mar. 8, 2007

Related U.S. Application Data

(63) Continuation of application No. 10/968,060, filed on Oct. 20, 2004, now Pat. No. 7,355,350.

(30) Foreign Application Priority Data

Oct. 20, 2003 (KR) ..... 10-2003-0072865

(51) Int. Cl.
*G09G 3/28* (2006.01)

(52) U.S. Cl. ..... 345/60; 315/169.4

(58) Field of Classification Search ... 315/169.1–169.4; 345/60, 66, 67, 68, 211, 37
See application file for complete search history.

(56) References Cited

U.S. PATENT DOCUMENTS 3,343,128 A 9/1967 Rogers
3,559,190 A 1/1971 Bitzer et al.
3,601,531 A 8/1971 Bitzer et al.
3,601,532 A 8/1971 Bitzer et al.
3,626,244 A 12/1971 Holz (Continued)

FOREIGN PATENT DOCUMENTS

EP 0 078 648 B1 1/1986

(Continued)

OTHER PUBLICATIONS

*Electronic Device Image Display*, "Technical Report of the Institute of Television Engineers", vol. 7, No. 29, pp. 1-25.

*Primary Examiner*—Douglas W Owens
*Assistant Examiner*—Ephrem Alemu
(74) *Attorney, Agent, or Firm*—McKenna Long & Aldridge LLP

(57) ABSTRACT

An energy recovery circuit for a plasma display panel charges a panel capacitor using energy within an inductor and recovers the energy from the panel capacitor. The energy recovery circuit supplies the panel capacitor with a clamping voltage enabling a potential of the panel capacitor to be constantly maintained. A controller controls the energy recovery circuit to supply the clamping voltage to the panel capacitor within a period taken to discharge a current of the inductor from a maximum value to a current level greater than zero. The charging timing point of the panel capacitor occurs prior to the current $I_L$ of the inductor L being discharged to zero and/or prior to the panel capacitor Cp being charged up to the sustain potential Vs.

16 Claims, 6 Drawing Sheets

U.S. PATENT DOCUMENTS 3,654,388 A 4/1972 Slottow et al.
3,654,537 A 4/1972 Coffey
3,659,190 A 4/1972 Galluppi
3,702,434 A 11/1972 Ryan
3,749,977 A 7/1973 Silker
3,771,040 A 11/1973 Fletcher et al.
3,777,182 A 12/1973 Peters
3,777,183 A 12/1973 Peters
3,780,339 A 12/1973 Mayle
3,786,485 A 1/1974 Wojcik
3,821,596 A 6/1974 Leuck
3,821,599 A 6/1974 Peters
3,821,606 A 6/1974 Buozynski
3,833,833 A 9/1974 Nelson
3,836,838 A 9/1974 Homer et al.
3,859,560 A 1/1975 Peters
3,869,644 A 3/1975 Yano et al.
3,890,562 A 6/1975 West
3,914,617 A 10/1975 Corbel
3,924,172 A 12/1975 Gregorich
3,931,528 A 1/1976 Farnsworth et al.
3,935,529 A 1/1976 Kalmanash et al.
3,953,785 A 4/1976 Bell, Jr.
3,967,157 A 6/1976 Hada et al.
3,987,337 A 10/1976 Nishida et al.
3,991,416 A 11/1976 Byles et al.
4,021,607 A 5/1977 Amano
4,024,429 A 5/1977 Glaser
4,070,663 A 1/1978 Kanatani et al.
4,073,003 A 2/1978 Chambers
4,073,004 A 2/1978 Chambers et al.
4,091,309 A 5/1978 Strom
4,092,566 A 5/1978 Chambers et al.
4,099,097 A 7/1978 Schermerhorn et al.
4,100,535 A 7/1978 Bitzer et al.
4,122,514 A 10/1978 Amin
4,131,939 A 12/1978 Day
4,140,944 A 2/1979 Miller
4,143,297 A 3/1979 Fischer
4,176,392 A 11/1979 Cronin et al.
4,180,762 A 12/1979 Weber
4,189,729 A 2/1980 Baker et al.
4,203,055 A 5/1980 Chambers et al.
4,227,123 A 10/1980 Dietz
4,238,793 A 12/1980 Hochstrate
4,245,285 A 1/1981 Weiss
4,253,049 A 2/1981 Frame et al.
4,253,097 A 2/1981 Hochstrate
4,254,362 A 3/1981 Tulleners
4,268,898 A 5/1981 Brown
4,277,728 A 7/1981 Stevens
4,286,314 A 8/1981 Molyneux-Berry
4,300,090 A 11/1981 Weber
4,303,918 A 12/1981 Reagan et al.
4,316,123 A 2/1982 Kleen et al.
4,333,138 A 6/1982 Huber
4,347,509 A 8/1982 Hardway et al.
4,349,816 A 9/1982 Miller et al.
4,392,084 A 7/1983 Rebeschi et al.
4,405,889 A 9/1983 Overstreet et al.
4,405,975 A 9/1983 Overstreet et al.
4,446,513 A 5/1984 Clenet
4,485,379 A 11/1984 Kinoshita et al.
4,492,957 A 1/1985 Marentic
4,496,879 A 1/1985 Suste
4,523,189 A 6/1985 Takahara et al.
4,527,096 A 7/1985 Kindlmann
4,550,274 A 10/1985 Weber
4,553,039 A 11/1985 Stifter
4,570,159 A 2/1986 Criscimagna et al.
4,574,280 A 3/1986 Weber
4,574,342 A 3/1986 Runyan
4,595,920 A 6/1986 Runyan
4,635,052 A 1/1987 Aoike et al.
4,682,233 A 7/1987 Hinn
4,684,849 A 8/1987 Otsuka et al.
4,707,692 A 11/1987 Higgins et al.
4,728,864 A 3/1988 Dick
4,733,228 A 3/1988 Flegal
4,737,687 A 4/1988 Shinoda et al.
4,772,884 A 9/1988 Weber et al.
4,855,891 A 8/1989 Paul
4,855,892 A 8/1989 Lower
4,900,987 A 2/1990 Otsuka et al.
4,924,218 A 5/1990 Weber et al.
5,089,755 A 2/1992 Wilber
5,541,479 A 7/1996 Nagakubo
5,703,437 A 12/1997 Komaki
5,791,960 A 8/1998 Fukuta et al.
5,818,168 A 10/1998 Ushifusa et al.
5,828,353 A 10/1998 Kishi et al.
5,858,616 A 1/1999 Tanaka et al.
5,883,462 A 3/1999 Ushifusa et al.
5,900,694 A 5/1999 Matsuzaki et al.
5,952,036 A 9/1999 Tadaki et al.
6,011,355 A * 1/2000 Nagai ..... 315/169.3
6,611,099 B1 8/2003 Murata et al.
6,633,285 B1 * 10/2003 Kigo et al. ..... 345/204
6,963,174 B2 11/2005 Lee et al.
6,989,828 B2 * 1/2006 Correa et al. ..... 345/211
2001/0005188 A1 * 6/2001 Watanabe ..... 345/60
2003/0160569 A1 8/2003 Kim et al.

FOREIGN PATENT DOCUMENTS

EP 1 256 925 A2 11/2002
JP 51-71730 6/1976
JP 51-115734 10/1976
JP 52-95156 8/1977
JP 55-113237 9/1980
JP 58-53344 11/1983
JP 59-137992 8/1984
JP 2002-108278 4/2002
JP 2002-123215 4/2002
JP 2002-132212 5/2002

* cited by examiner

APPARATUS FOR ENERGY RECOVERY OF PLASMA DISPLAY PANEL

This application is a continuation of application Ser. No. 10/968,060, filed on Oct. 20, 2004, which claims priority under 35 U.S.C. § 119(a) on Korean Patent Application No. 10-2003-0072865 filed on Oct. 20, 2003, which is hereby incorporated by reference as if fully set forth herein.

This Nonprovisional application claims priority under 35 U.S.C. § 119(a) on Patent Application No. 10-2003-0072865 filed in Korea on Oct. 20, 2003, the entire contents of which are hereby incorporated by reference.

BACKGROUND OF THE INVENTION

1. Field of the Invention

The present invention relates to a plasma display panel, and more particularly, to an apparatus for energy recovery of a plasma display panel.

2. Description of the Background Art

Generally, a plasma display panel (hereinafter abbreviated PDP) consisting of a plurality of matrix type cells displays an image by turning on/off discharge cells in a manner of bringing about high-voltage discharges in the cells, respectively. However, the discharge characteristic of PDP needs power consumption relatively greater than that of other display devices. In order to reduce the power consumption, unnecessary power consumption occurring in the course of a driving process without direct relation to discharge needs to be minimized as well as luminous efficiency is raised.

An AC type PDP utilizes surface discharge occurring on a surface of a dielectric coated on electrodes. In the AC type PDP, a drive pulse for sustain discharge of tens of thousands to several millions cells is a high voltage ranging from several tens volts to several hundreds volts and its frequency exceeds several hundreds KHz. When the drive pulse of high voltage is applied to the cell, an electric charging/discharge of high capacitance takes place.

In case that the electric charging/discharge occurs in PDP, a capacitance load of a panel causes no energy consumption. Yet, since the drive pulse is generated from the switching of DC power, considerable energy loss is brought about in PDP. Specifically, if an excessive current flows within a cell on discharge, the energy loss increases. The energy loss triggers a temperature rise of switching devices to break down the switching devices of a drive circuit in the worst case. In order to recover the energy unnecessarily occurring within the panel, the drive circuit of PDP includes an energy recovery circuit.

FIG. 1 is a diagram of an energy recovery circuit according to a related art.

Referring to FIG. 1, an energy recovery circuit comprises first and second switches S1 and S2 connected parallel between an inductor L and an external capacitor Css, a third switch S3 for supplying a sustain voltage Vs to a panel capacitor Cp, and a fourth switch S4 for supplying a ground voltage GND to the panel capacitor Cp. And, first and second diodes D1 and D2 are connected between the first and second switches S1 and S2 to put limitation on a reverse current.

The panel capacitor Cp equivalently indicates a capacitance value of the panel, and reference numbers Re and R_Cp equivalently represent parasitic resistances of an electrode provided to the panel and the corresponding cell, respectively. The first to fourth switches S1, S2, S3, S4 are implemented by semiconductor switch devices such as MOSFET devices, respectively.

Assuming that the external capacitor Css is charged with a voltage of Vs/2, an operation of the energy recovery circuit shown in FIG. 1 is explained with reference to FIG. 2 as follows in FIG. 2, Vp indicates a voltage of the panel capacitor Cp and IL indicates a current of the inductor L.

First of all, the first switch S1 is turned on and maintains a turned-on state during an ER-UP period. During the ER-UP period, the second to fourth switches S2 to S4 maintain a turned-off state. If so, the voltage stored in the external capacitor Css is supplied to the inductor L via the first switch S1 and the first diode D1. The inductor L constructs a serial LC resonance circuit together with the panel capacitor Cp, whereby the panel capacitor Cp starts to be charged with a resonance waveform. During the ER-UP period, the current IL of the inductor L is discharged to zero after having been charged with a positive peak by electric charges from the external capacitor Css and the voltage Vp of the panel capacitor Cp is charged up to the sustain voltage Vs as a maximum potential.

If the current of the inductor L becomes zero, the third switch S3 is turned on to maintain the turned-on state during a first clamping period. During the first clamping period, the first switch S1 maintains the turned-on state but the second and fourth switches S2 and S4 maintain the turned-off state. During the first clamping period, the sustain voltage Vs is supplied to the panel capacitor Cp via the third switch S3. Hence, the voltage Vp of the panel capacitor Cp is constantly maintained at the sustain potential Vs. The current IL of the inductor L maintains zero during the first clamping period. Thus, plasma discharge occurs between both ends of the panel capacitor Cp within the cell while the voltage Vp is of the panel capacitor Cp is constantly maintained.

After expiration of the first clamping period, the second switch S2 is turned on to maintain a turned-on state during an ER down (hereinafter abbreviated ER-DN) period. During the ER-DN period, the third switch S3 is turned off but the first and fourth switches S1 and S4 maintain turned-off states, respectively. If so, a null power failing to contribute to the plasma discharge is recovered to the external capacitor Css from the panel capacitor Cp via the inductor L, second diode D2, and second switch S2. During the ER-DN period, the current IL of the inductor L is discharged to zero after having been charged up to a negative peak by electric charges from the panel capacitor Cp and the voltage Vp of the panel capacitor Cp is discharged down to the ground potential GND from the sustain potential Vs.

If the current of the inductor L becomes zero at the time point of expiration of the ER-DN period, the fourth switch S4 is turned on to maintain a turned-on state during a second clamping period. And, the second switch S2 is turned off but the first and third switches S1 and S3 maintain turned-off states, respectively during the second clamping period. The ground voltage GND is supplied to the panel capacitor Cp via the fourth switch S4 during the second clamping period. Hence, the voltage Vp of the panel capacitor Cp is constantly maintained at the ground potential GND.

However, in the related art energy recovery circuit, the time required for charging the panel capacitor Cp up to the sustain voltage Vs, i.e. the ER-UP period, becomes elongated excessively. Hence, it is difficult to apply the related art recovery circuit to the high-resolution PDP. Moreover, if the voltage Vp of the panel capacitor Cp smoothly increases, the timing point that the plasma discharge occurs within the cell is elongated to make the plasma discharge unstable. Hence, a width of the drive pulse needs to be increased to implement the stabilization of the plasma discharge.

SUMMARY OF THE INVENTION

Accordingly, an object of the present invention is to solve at least the problems and disadvantages of the background art.

An object of the present invention is to provide an apparatus for energy recovery of a plasma display panel, by which a charging time of a panel capacitor is reduced and by which a plasma discharge delay within a cell is minimized.

According to an embodiment of the present invention, an apparatus for energy recovery of a plasma display panel, which includes front and rear substrates confronting each other, a pair of transparent electrodes provided to a confronting surface of the front substrate, metal electrodes provided to a pair of the transparent electrodes, respectively, a dielectric layer covering both of the transparent electrodes and the metal electrodes, a protective layer coated on the dielectric layer, an address electrode provided to a confronting surface of the rear substrate, a dielectric layer covering the address electrode, a barrier rib formed on the dielectric layer, a discharge cell partitioned by the barrier rib, and a fluorescent layer coated on an inside of the discharge cell, includes a panel capacitor, an energy recovery circuit charging the panel capacitor using energy charged within an inductor, the energy recovery circuit recovering the energy from the panel capacitor, the energy recovery circuit supplying the panel capacitor with a clamping voltage enabling a potential of the panel capacitor to be constantly maintained and a controller controlling the energy recovery circuit to supply the clamping voltage to the panel capacitor within a period taken to discharge a current of the inductor to a current level higher than zero from a maximum value.

According to an embodiment of the present invention, an apparatus for energy recovery of a plasma display panel, which includes front and rear substrates confronting each other, a pair of transparent electrodes provided to a confronting surface of the front substrate, metal electrodes provided to a pair of the transparent electrodes, respectively, a dielectric layer covering both of the transparent electrodes and the metal electrodes, a protective layer coated on the dielectric layer, an address electrode provided to a confronting surface of the rear substrate, a dielectric layer covering the address electrode, a barrier rib formed on the dielectric layer, a discharge cell partitioned by the barrier rib, and a fluorescent layer coated on an inside of the discharge cell, includes a charging circuit for charging a panel capacitor up to an intermediate level set to 20%~100% of a maximum voltage of the panel capacitor and a clamping circuit for supplying the maximum voltage to the panel capacitor at a timing point of charging the panel capacitor up to the intermediate voltage.

Therefore, the apparatus for energy recovery of the plasma display panel according to the present invention advances the charging timing point of the panel capacitor prior to a timing point of discharging the current $I_L$ of the inductor L down to zero or chagrin the panel capacitor Cp up to the sustain potential Vs, thereby enabling to reduce the charging time of the panel capacitor and to minimize the plasma discharge delay within the cell of PDP.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
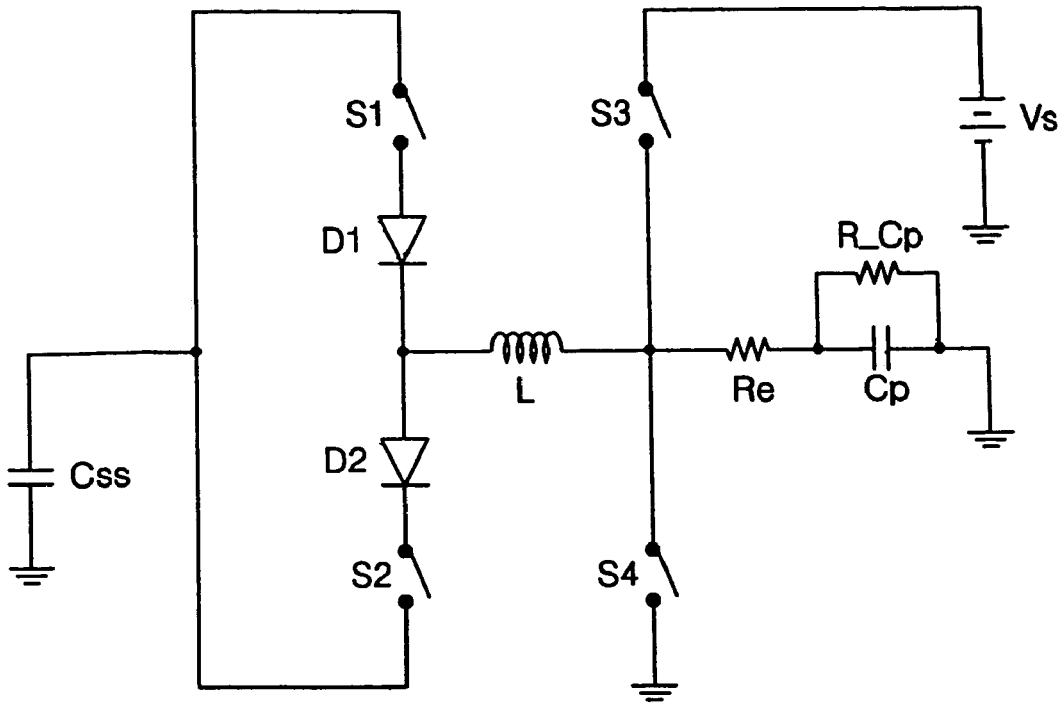
FIG. 1 is a diagram of an energy recovery circuit according to a related art.
Figure 2:
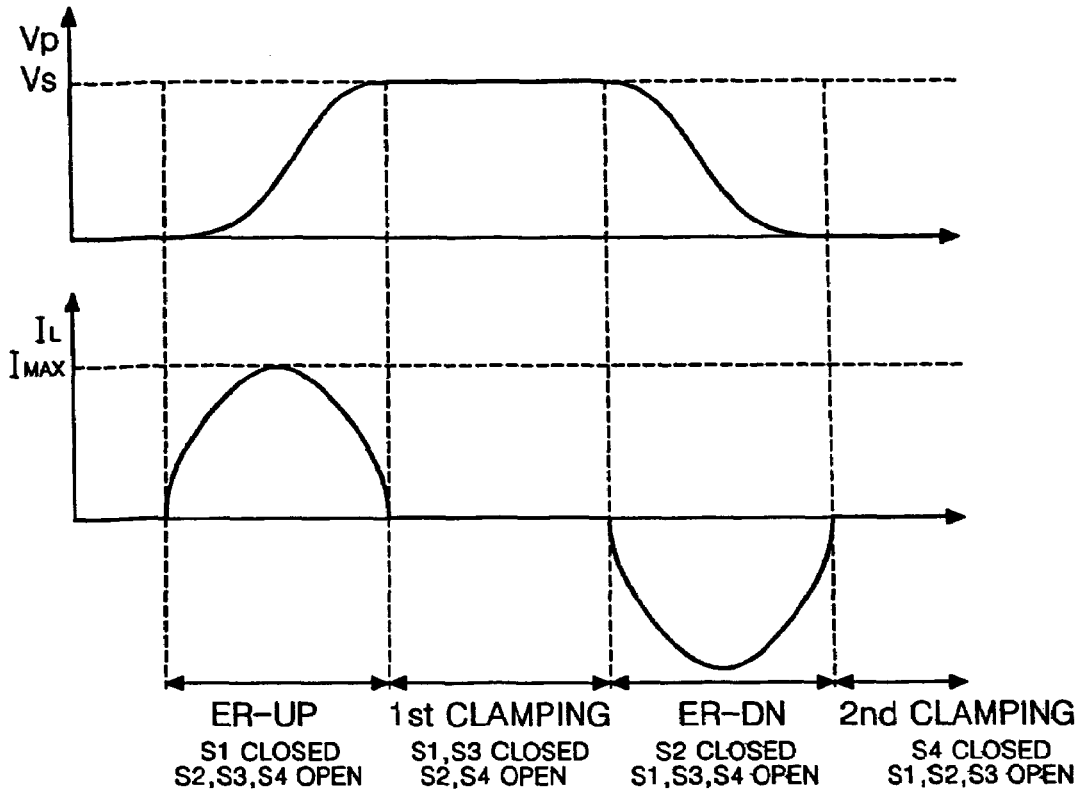
FIG. 2 is a waveform graph of inductor current vs. panel capacitor voltage in the energy recovery circuit on FIG. 1.

Preferred embodiments of the present invention will be described in a more detailed manner with reference to the drawings.

According to an embodiment of the present invention, an apparatus for energy recovery of a plasma display panel, which includes front and rear substrates confronting each other, a pair of transparent electrodes provided to a confronting surface of the front substrate, metal electrodes provided to a pair of the transparent electrodes, respectively, a dielectric layer covering both of the transparent electrodes and the metal electrodes, a protective layer coated on the dielectric layer, an address electrode provided to a confronting surface of the rear substrate, a dielectric layer covering the address electrode, a barrier rib formed on the dielectric layer, a discharge cell partitioned by the barrier rib, and a fluorescent layer coated on an inside of the discharge cell, includes a panel capacitor, an energy recovery circuit charging the panel capacitor using energy charged within an inductor, the energy recovery circuit recovering the energy from the panel capacitor, the energy recovery circuit supplying the panel capacitor with a clamping voltage enabling a potential of the panel capacitor to be constantly maintained and a controller controlling the energy recovery circuit to supply the clamping voltage to the panel capacitor within a period taken to discharge a current of the inductor to a current level higher than zero from a maximum value.

The energy recovery circuit supplies the clamping voltage until a current of the inductor is discharged down to a current level set to 100%~20% of a maximum current of the inductor.

The energy recovery circuit supplies the clamping voltage until the panel capacitor is charged up to a voltage set to 20%~100% of a maximum voltage of the panel capacitor.

And, the energy recovery circuit includes a capacitor supplying electric charges to the inductor, the capacitor charged with a voltage supplied via the inductor, a first switch circuit for switching a current path between the capacitor and the inductor, and a second switch circuit for switching a current path between a clamping voltage source generating the clamping voltage and the panel capacitor.

According to an embodiment of the present invention, an apparatus for energy recovery of a plasma display panel, which includes front and rear substrates confronting each other, a pair of transparent electrodes provided to a confronting surface of the front substrate, metal electrodes provided to a pair of the transparent electrodes, respectively, a dielectric layer covering both of the transparent electrodes and the metal electrodes, a protective layer coated on the dielectric layer, an address electrode provided to a confronting surface of the rear substrate, a dielectric layer covering the address electrode, a barrier rib formed on the dielectric layer, a discharge cell partitioned by the barrier rib, and a fluorescent layer coated on an inside of the discharge cell, includes a charging circuit for charging a panel capacitor up to an intermediate level set to 20%~100% of a maximum voltage of the panel capacitor and a clamping circuit for supplying the maximum voltage to the panel capacitor at a timing point of charging the panel capacitor up to the intermediate voltage.

The charging circuit includes an inductor connected to the panel capacitor.

And, the clamping circuit supplies a clamping voltage until a current of the inductor is discharged down to a current level set to 100%~20% of a maximum current of the inductor.

Hereafter, the embodiments of the present invention will be described with reference to the drawings.

Figure 3:
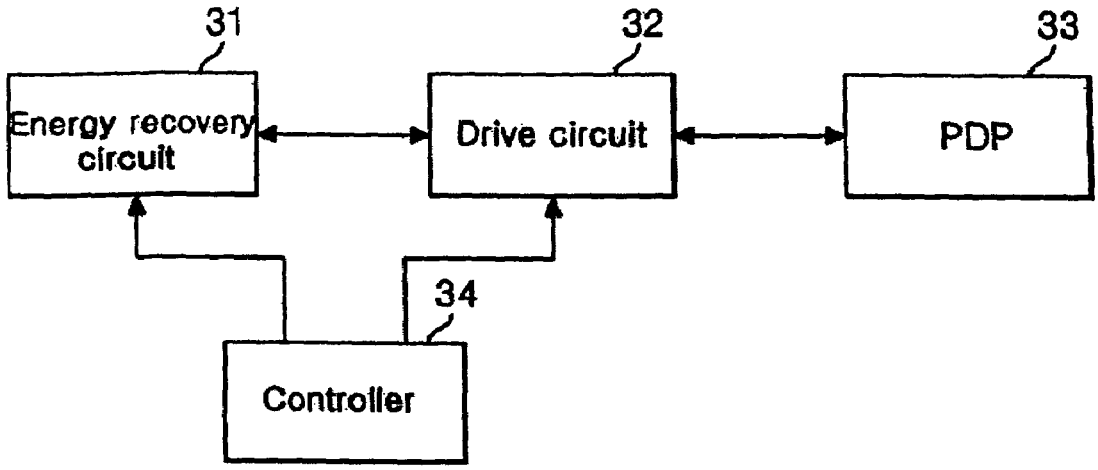
FIG. 3 is a block diagram of an apparatus for energy recovery of a plasma display panel according to an embodiment of the present invention.

FIG. 3 is a block diagram of an apparatus for energy recovery of a plasma display panel according to an embodiment of the present invention.

Referring to FIG. 3, an apparatus for energy recovery of a plasma display panel according to an embodiment of the present invention includes an energy recovery circuit 31 for charging a PDP 33 using a null power recovered from the PDP 33, a drive circuit 32 connected between the energy recovery circuit 31 and the PDP 33, and a controller 34 controlling the energy recovery circuit 31 and the drive circuit 32 of the PDP 33.

Figure 4:
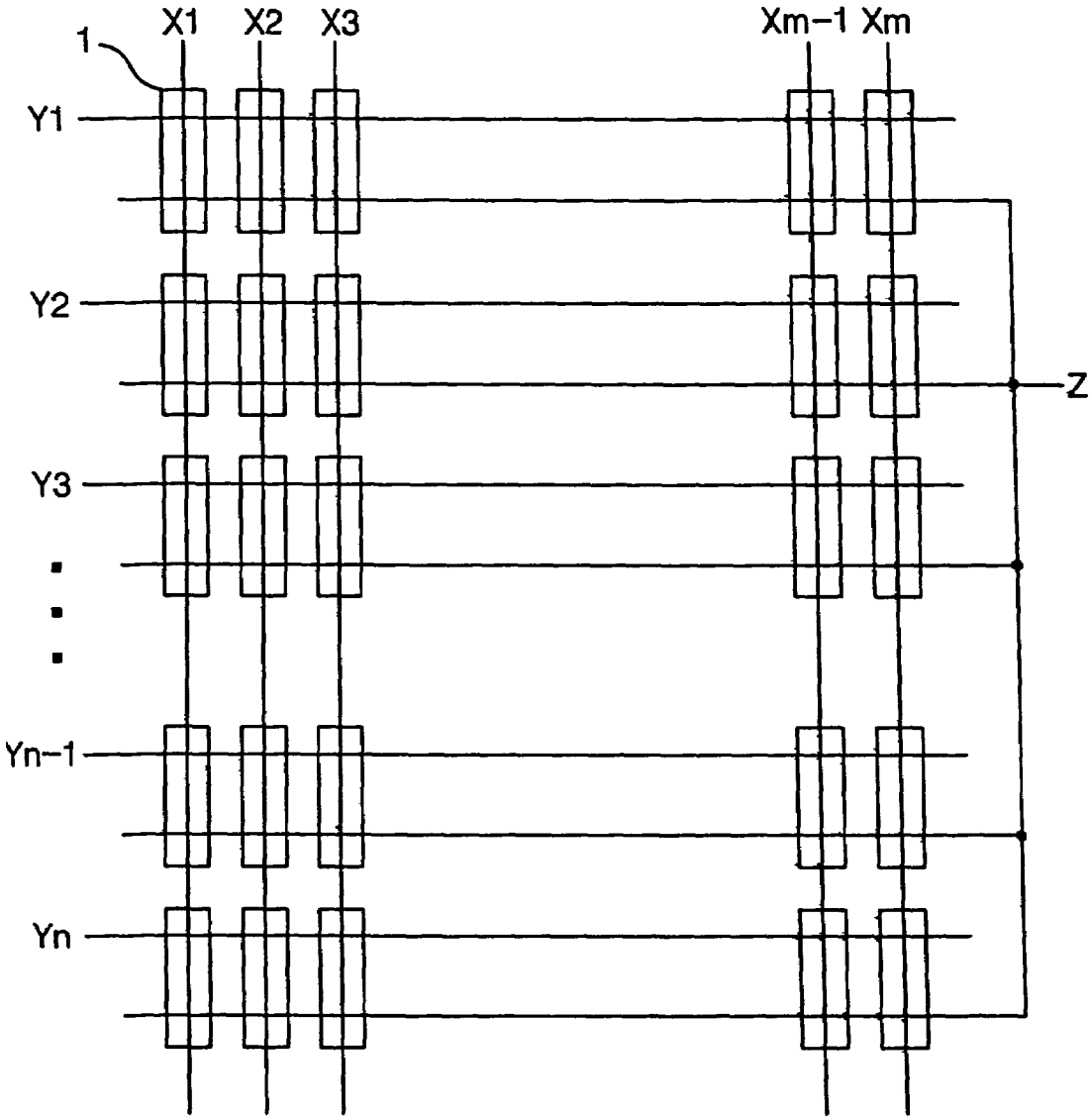
FIG. 4 is a diagram of one example of the plasma display panel in FIG. 3.

FIG. 4 is a diagram of one example of the plasma display panel in FIG. 3.

The PDP 33 can be implemented with a PDP having the cell and electrode configurations known to the public. For instance, the PDP 33 can be implemented by a 3-electrodes PDP shown in FIG. 4. Scan electrodes Y1 to Yn and a sustain electrode Z, as shown in FIG. 4, are formed on an upper plate of the 3-electrodes PDP. And, address electrodes X1 to Am crossing with the scan electrodes Y1 to Yn and the sustain electrode Z are formed on a lower plate of the 3-electrodes PDP. A plurality of cells 1 are provided to a plurality of intersections between the scan electrodes Y1 to Yn, sustain electrode Z, and address electrodes X1 to Xm to display colors including red, green, and blue, respectively. A dielectric layer (not shown in the drawing) and an MgO protective layer (not shown in the drawing) are stacked on the upper plate. And, a plurality of barrier ribs are formed on the lower-plate to partition a plurality of the cells 1. A mixed inert gas such as He+Xe, Ne+Xe, He+Xe+Ne, and he like is injected in the cells 1 of the PDP 33. Each of the cells 1 of the PDP 33 can be equivalently represented by the panel capacitor Cp shown in FIG. 1.

The energy recovery circuit 31 can be implemented with the circuit shown in FIG. 1 or any other energy recovery circuit known to the public. The energy recovery circuit 31 includes a charging circuit for charring the panel capacitor of the PDP 33 and a clamping circuit for clamping a maximum voltage of the panel capacitor Cp. In case of implementing the energy recovery circuit 31 with the circuit shown in FIG. 1, the charging circuit includes the external capacitor Css, the inductor L, and the first and second switches S1 and S2 and the clamping circuit includes the third switch S3. The energy recovery circuit 31 recovers a null power recovered from the panel capacitor Cp of the PDP 33, i.e., energy, and then charges the panel capacitor Cp under the control of the controller 34 in a manner of charging the inductor L with a current and discharging a current from the inductor L using the recovered energy. Under the control of the controller 34, the energy recovery circuit 31 supplies the sustain voltage Vs to the PDP 33 to clamp the panel capacitor Cp with the sustain potential Vs or supplies the ground voltage GND to the PDP 33 to clamp the panel capacitor Cp with the ground potential GND.

The PDP 33 is charged up to a prescribed voltage and the null power is recovered from the PDP 33. The PDP 33 is then re-charged using the recovered null power.

Figure 5:
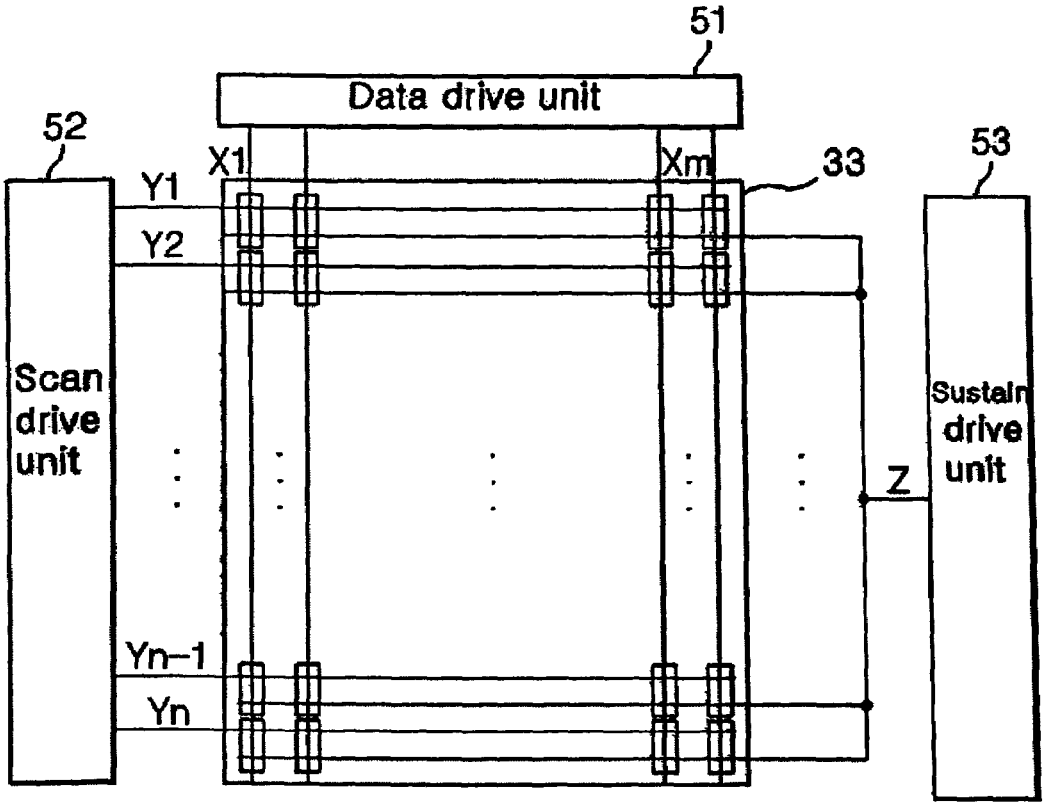
FIG. 5 is a detailed block diagram of a drive circuit of the plasma display panel in FIG. 3.

FIG. 5 is a detailed block diagram of a drive circuit of the plasma display panel in FIG. 3.

The drive circuit 32 includes a data drive unit 51, a scan drive unit 52, and a sustain drive unit 53 as shown in FIG. 5. The data drive unit 51 receives digital video data to latch and then supplies a data voltage to address electrodes X1 to Xm each 1-horizontal period using the voltage supplied from the energy recovery circuit 31. The scan drive unit 52 simultaneously supplies an initialization waveform to scan electrodes Y1 to Yn during a reset period using the voltage supplied from the energy recovery circuit 31, sequentially supplies a scan pulse synchronized with the data to the scan electrodes Y1 to Yn during an address period, and then supplies a sustain pulse to the scan electrodes Y1 to Yn simultaneously during a sustain period, in turn. The sustain drive unit 52 preferentially supplies a prescribed DC bias voltage to the sustain electrodes Z during the address period using the voltage supplied from the energy recovery circuit 31 and then alternates to operate with the scan drive unit 52 during the sustain period to supply the sustain pulse to the sustain electrodes Z.

The controller 34 generates control signals controlling the energy recovery circuit 31 and switch devices within the drive circuit 32 using a vertical synchronization signal Vsync, a horizontal synchronization signal Hsync, and a clock signal CLK. Specifically, the controller 34 controls the switch devices within the energy recovery circuit 31 so that the voltage Vp of the panel capacitor Cp can be clamped by the sustain potential Vs before the current IL of the inductor L included in the energy recovery circuit 31 is discharged down to zero or before the panel capacitor Cp of the PDP 33 is charged with the maximum potential, i.e., the sustain potential Vs.

Figure 6:
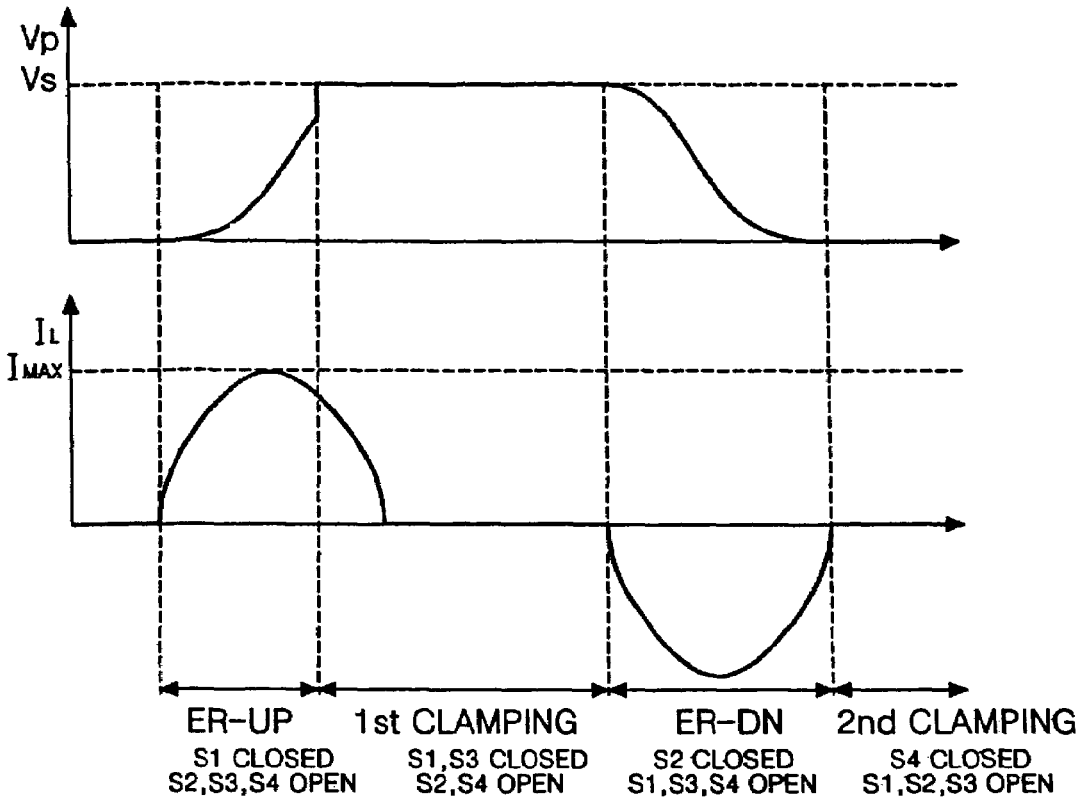
FIG. 6 is a waveform graph of an operation of an apparatus for energy recovery of a plasma display panel according to an embodiment of the present invention.

FIG. 6 is a waveform graph of an operation of an apparatus for energy recovery of a plasma display panel according to an embodiment of the present invention.

Assuming that the energy recovery circuit 31 is implemented by the energy recovery circuit shown in FIG. 1 and that the external capacitor Css is charged with the voltage of Vs/2, an operation of the energy recovery circuit is explained with reference to FIG. 6 as follows.

Referring to FIG. 6, the controller 34 turns on the first switch S1 and maintains a turned-on state during an ER-UP period. The second to fourth switches S2 to S4 maintain turned-off states during the ER-UP period, respectively. If so, the voltage stored in the external capacitor Css is supplied to the inductor L via the first switch S1 and the first diode D1. By the LC resonance of the combination of the inductor L and the panel capacitor Cp during this period, the current IL of the inductor L is charged up to a positive peak to be discharged and the voltage Vp of the panel capacitor Cp is charged.

At a beginning point of a first clamping period (hereinafter abbreviated clamping timing point), the controller 34 turns on the third switch S3 to initiate to supply the sustain voltage Vs to the panel capacitor Cp. During the first clamping period, the first switch S1 maintains the turned-on state but the second and fourth switches maintain the turned-of states, respectively. The clamping timing point corresponds to a timing point prior to discharging the current IL of the inductor L down to zero and prior to charging the panel capacitor Cp up to the sustain potential Vs. The clamping timing point is a discharge timing point that the current IL of the inductor L is set to 100%~20% of a maximum current IMAX or a charging timing point that the voltage Vp of the panel capacitor Cp is set to 20%~100% of the sustain potential Vs or a maximum voltage. At the clamping timing point, the voltage Vp of the panel capacitor Cp abruptly increases up to the sustain potential Vs or the maximum potential. The current IL of the inductor L is discharged down to zero by an early stage of the first clamping period and keeps maintaining zero until an end timing point of the first clamping period. Thus, plasma discharge occurs between both ends of the panel capacitor Cp within the corresponding cell while the voltage Vp of the panel capacitor Cp is constantly maintained at the maximum potential.

Thus, the apparatus for energy recovery of the plasma display panel and clamping method thereof according to the present invention reduce the delay of the plasma discharge by shortening the ER-UP period in a manner of clamping the voltage of the panel capacitor Cp by the maximum potential at the clamping timing point and by stabilizing the panel capacitor Cp on an early stage with the maximum potential enabling to trigger the plasma discharge within the cell.

After expiration of the first clamping period, the controller 34 turns off the first and third switched S1 and S3 but turns on the second switch S2 to maintain the turned-on state during an ER-DN period. And, the fourth switch S4 maintains a turned-of state during the ER-DN period. If so, a null power failing to contribute to the plasma discharge in the panel capacitor Cp is recovered to the external capacitor Css via the inductor L. second diode D2, and second switch S2. During the ER-DN period, the current IL of the inductor L is discharged down to zero after having been charged up to a negative peak by the electric charges from the panel capacitor Cp and the voltage Vp of the panel capacitor Cp is discharged down to the ground potential GND from the sustain potential Vs.

If the current IL of the inductor L becomes zero at an end timing point of the ER-DN period, the controller 34 turns of the second switch S2 but turns on the fourth switch S4 to maintain a turned-on state during a second clamping period. And, the first and third switches S1 and S3 maintain turned-off states during the second clamping period, respectively. The ground voltage GND is supplied to the panel capacitor Cp via the fourth switch S4 during the second clamping period. Hence, the voltage Vp of the panel capacitor Cp is constantly maintained at the ground potential GND.

Accordingly, the apparatus for energy recovery of the plasma display panel according to the present invention advances the charging timing point of the panel capacitor prior to a timing point of discharging the current $I_L$ of the inductor L down to zero or charging the panel capacitor Cp up to the sustain potential Vs, thereby enabling to reduce the charging time of the panel capacitor and to minimize the plasma discharge delay within the cell of PDP.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

a scan electrode and a sustain electrode formed on a first substrate;

an address electrode formed on a second substrate;

a plurality of barrier ribs provided between the first and second substrate;

a cell being defined by the scan, sustain and address electrodes;

a panel capacitor; and an energy recovery circuit that charges the panel capacitor during a charging period, maintains the panel capacitor at a maximum potential during a clamping period and recovers power from the panel capacitor during a recovery period through an inductor, during the charging period, energy is stored in the inductor until the magnitude of the inductor current reaches a maximum value and the energy recovery circuit supplies the panel capacitor with a clamping voltage, wherein the clamping voltage is supplied to the panel capacitor after the current of the inductor reaches a maximum value but before the current of the inductor reaches zero, during the clamping period, the panel capacitor reaches and maintains the maximum potential before the current of the inductor reaches zero.

2. The plasma display apparatus as claimed in claim 1, wherein at least one of the mixed gas He+Xe, Ne+Xe, He+Xe+Ne is injected in the cell.

3. The plasma display apparatus as claimed in claim 1, wherein the scan electrode(Y) and the sustain electrode(Z) are arranged in YZYZ order.

4. The plasma display apparatus as claimed in claim 1, further comprising:

a data drive unit supplying a data voltage to the address electrode during an address period;

a scan drive unit supplying an initialization waveform to the scan electrode during a reset period, a scan pulse synchronized with the data voltage to the scan electrode during the address period, and a sustain pulse to the scan electrode during a sustain period;

and a sustain drive unit supplying a bias voltage to the sustain electrode during the address period and a sustain pulse to sustain electrode during the sustain period, wherein the sustain pulse is supplied from the energy recovery circuit.

5. The plasma display apparatus as claimed in claim 4, wherein the data drive unit supplies the data voltage to the address electrode in only one side of the plasma display apparatus.

6. The plasma display apparatus as claimed in claim 1, wherein the duration the charging period is different from the duration of the recovery period.

7. The plasma display apparatus as claimed in claim 6, wherein the recovery period is longer than the charging period.

8. The plasma display apparatus as claimed in claim 1, wherein the energy recovery circuit comprises:

a first switch coupled to between a first voltage source and the inductor, and a second switch coupled between a second voltage source and the panel capacitor.

9. The plasma display apparatus as claimed in claim 8, wherein the second switch is activated at approximately the time when the inductor current reaches 100%~20% of the maximum current value of the inductor.

10. The plasma display apparatus as claimed in claim 8, wherein the second switch is activated at approximately the time when the panel capacitor voltage reaches 20%~100% of the maximum voltage value of the panel capacitor.

11. A plasma display apparatus having panel electrodes and a panel capacitor, comprising:

an inductor coupled to the panel electrodes;

a first switch coupled between a first voltage source and the inductor, and a second switch coupled between a second voltage source and the panel capacitor, wherein the second switch is activated within a period taken to discharge a current of the inductor to a current level greater than zero from a maximum value and a first time period in which the panel capacitor voltage rises from a minimum voltage to a maximum voltage is different from a second time period in which the panel capacitor voltage falls from a maximum voltage to a minimum voltage.

12. The plasma display apparatus as claimed in claim 11, wherein the second switch is activated at approximately the time when the inductor current reaches 100%~20% of the maximum current value of the inductor.

13. The plasma display apparatus as claimed in claim 11, wherein the second switch is activated at approximately the time when the panel capacitor voltage reaches 20%~100% of the maximum voltage value of the panel capacitor.

14. The plasma display apparatus as claimed in claim 11, wherein the second time period is longer than the first time period.

15. The plasma display apparatus as claimed in claim 11, further comprising a plurality of barrier ribs, wherein the plurality of electrodes comprise a scan electrode and a sustain electrode formed on a first substrate; and an address electrode formed on a second substrate the plurality of barrier ribs are provided between the first and second substrate, and a cell is defined by the scan, sustain and address electrodes.

16. The plasma display apparatus as claimed in claim 15, wherein the scan electrode(Y) and the sustain electrode(Z) are arranged in YZYZ order.

* * * * *